United States Patent [19]

Kehoe

[11] 4,031,818

[45] June 28, 1977

[54] APPARATUS FOR PREPARING SEALED ENVELOPE UNITS WITH MESSAGES

[75] Inventor: James W. Kehoe, Shelby, Ohio

[73] Assignee: GAF Corporation, New York, N.Y.

[22] Filed: Dec. 4, 1975

[21] Appl. No.: 637,694

Related U.S. Application Data

[62] Division of Ser. No. 515,428, Oct. 16, 1974, abandoned.

[52] U.S. Cl. ..... 93/63 R; 93/61 R

[51] Int. Cl.[2] ..... B31B 19/00

[58] Field of Search ..... 229/73, 69; 93/63 R, 93/63 M, 61 R; 53/31, 206

[56] References Cited

UNITED STATES PATENTS

| | | | |
|---|---|---|---|
| 3,552,282 | 1/1971 | Wilson | 93/61 R |
| 3,652,007 | 3/1972 | MacDougall | 229/73 |
| 3,808,768 | 5/1974 | Dobbs | 93/63 R X |
| 3,833,167 | 9/1974 | Kapitan | 229/73 X |
| 3,866,822 | 2/1975 | Faltin et al. | 229/69 |
| 3,899,381 | 8/1975 | O'Brien et al. | 229/73 X |

*Primary Examiner*—James F. Coan

*Attorney, Agent, or Firm*—Walter C. Kehm; Arthur Dresner

[57] ABSTRACT

A multiple, potentially variable message printing method is disclosed which comprises: storing desired message information in a computer system; moving a single, continuous strip of paper in the direction of its long axis across printing means operated by said computer system to print the desired message information on the continuous strip; and thereafter folding and severing the single strip of paper to form a plurality of separate, sealed envelope units, each carrying a specific message which may be of variable content if desired. Alternatively, separate paper sheets are processed through such a computer system and then folded into separate message units.

7 Claims, 8 Drawing Figures

APPARATUS FOR PREPARING SEALED ENVELOPE UNITS WITH MESSAGES

This is a division of application Ser. No. 515,428, filed Oct. 16, 1974, and now abandoned.

BACKGROUND OF THE INVENTION

Millions of business correspondence forms are utilized in commerce and the like, such as billing invoices, delivery notifications, and the like. At the present time, multi-sheet business forms, separated by carbon paper or other duplicating means, are sold by manufacturers and delivered to the users. The forms are removed from their shipping container and inserted in a typewriter which may be operated by a computer. The billing information or the like may be fed into a computer system which operates the typewriter, to place the desired billing information on the forms. Each form may differ in its information, in that the typewriter will insert a different customer with a different address, and a different billing amount for each form.

In the above prior art system, it is necessary for the form to carry severable, lateral side strips having holes into which the pins of a form feeding sprocket fit, so that there is precise control of the position of the data entered onto the various layers of the business form, which is typically pre-printed. The pre-printed portions must of course be in precise registration with the material which is added by the computerized typewriter.

After the desired information has been entered by the computerized typerwriter, the forms are manually served from each other, and the side strips with holes are removed. The forms may then be placed in an envelope.

An example of such a prior art process is shown in U.S. Pat. No. 3,652,007.

The amount of paper in the side strips generally constitutes approximately 10 percent of the entire paper used in the forms, and thus constitutes a significant waste of paper, since the side strips are discarded.

Furhermore, a considerable amount of manual labor is necessary to remove the forms from the typewriter, to separate the forms and insert them into envelopes, and the like. Additionally, a significant amount of waste and delay is encountered by the simple step of shipping the blank business forms to the processor, involving the added expense of packaging materials and shipping expenses.

In accordance with this invention, a complete process is provided for the production of message-containing envelopes in which the message may differ, beginning not with finished forms, but with raw paper strip or webbing, which may be conveniently provided in a large roll for continuous operation. The lateral, removable, perforated portions for alignment are unnecessary, resulting in a substantail savings in paper. Also, the shipping of blank business forms to various recipients, can be eliminated.

The end product of the process of this invention constitutes addressed bill envelopes or the like, ready for mailing having been produced in an automated manner from raw paper strip. Also, various novel envelope configurations made from a single paper strip are disclosed, which are particularly useful in themselves, and can be desirable utilized in conjunction with the method of this invention.

DESCRIPTION OF THE INVENTION

The invention of this application comprises a multiple message printing method for preparing invoices, bills, and the like, in which each individual bill or invoice can bear individualized information.

The desired message information is first stored in a computer system, for example, on magnetic tape or cards. Thereafter, a single, continuous strip of paper is moved in the direction of the long axis of the strip through printing means operated by the computer system, to print the desired message information on the continuous strip. Thereafter, the single strip of paper is folded and severed to form a plurality of separate, sealed envelope units, each carrying a specific message.

Preferably, the lines of folding of the envelope units are in longitudinal relation with the long axis of the strip, and the grain of the paper strip is likewise in longitudinal relation with the long axis. This provides a maximum strength and dimensional stability to the paper strip and the resulting envelope units during processing.

Because the entire printing operation is performed on the continuous strip in a single operation or series of operations, and because only a single strip of paper is used, it is unnecessary to provide lateral tear strips having alignment holes, with the resulting saving of paper described previously. If more than one printing operation is performed on the paper strip, they may be brought into registration with the use of conventional paper printing, folding, and cutting equipment, such as that which may be purchased from the Hamilton Tool Company of Hamilton, Ohio.

One particularly suitable computer-operated printing means is the Mead Dijit image system, a computerized jet printing system available from Mead Dijit, Inc. of Dayton, Ohio. This system is particularly advantageous, in that it can apply the desired printed subject matter to the continuous paper strip in a direction which is parallel to the long axis of the strip, even though the lines of printing and the like may be read in a direction transverse to the long axis of the strip. The system is so fast (printing up to 48,000 characters per second) that the size and speed of the computer may be the limiting factor in the production of printed envelope units.

Other, analogous printing means which may be used include electrostatic system such as the Xerox 1200 system, and optical system such as the Photon Corporation System, and preferably those which apply the desired printing in a direction parallel to the long axis of the strip.

In cases where the envelope units are to be further printed upon during use, opposite sides of the paper webbing can be pre-coated with an attapulgite coating on one side of the paper strip and pressure-rupturable microscopic capsules of a color reactant compound such as crystal violet lactone or the like, on the other side, as described, for example, in U.S. Pat. No. 2,730,457. Accordingly, when opposite sides of the paper strip are folded together into facing position, typing or printing on the envelope can result in a corresponding mark being formed on interior layers of the envelope unit as desired.

This kind of arrangement can be used by fuel oil companies, dairies, bakeries, and other businesses that deliver products in quantities that vary at the point of delivery. The addresses of the customers, and other pre-known information can be individually pre-printed on the envelope units, while the actual amounts of items delivered and the like can be printed on the form in more than one layer at a later date at the site of delivery or the like. This paper, coated with two reactive coatings, can be manufacture by processes currently utilized by the NCR Corporation of Dayton, Ohio.

The paper strip can be supplied to the computer-operated printing device and the other devices utilized in the method of this application from large rolls of paper. Accordingly, since rolls of paper can be spliced together in accordance with known newspaper printing technology, the process of this invention can be continuous and unlimited in duration.

The prior art computer printing process of, for example, U.S. Pat. No. 3,652,007, are performed on collated envelope assemblies. Typically, the apparatus must be periodically reloaded with new assemblies, resulting in only intermittent operation.

It is contemplated that a commercial establishment having, for example a series of bills to send out, can simply enter the necessary addressing and billing information on computer cards or magnetic computer tape. In some large business orgainizations, the billing information is already stored in this manner. Accordingly, the computer cards or tape can be simply fed into an appropriately programmed computer-operated jet printing system in accordance with the method of this invention, to result in the addressed bill envelopes being produced from a continuous roll of paper, suitable for mailing without further manual processing.

Alternatively, the roll of paper can be pre-cut into sheets and fed into a Xerox 1200 computer-operated photocopier, to achieve similar results. After photocopying, the sheets may be automatically folded into envelope units or the like.

If desired, the computer-operated jet printing device can include advertising messages and the like, which are selectively directed to only certain addresses, for example, to only addresses within a given number of states or the like. Simultaneously, the computer can be programmed to provide a different advertising message for addresses in another group of states, or to those names beginning with a certain letter, or any other criterion. Accordingly, the system of auotomated message printing described herein is flexible to a high degree, and can selectively provide a virtually infinite variety, from a single roll of paper, of separate messages which are sealed and ready for mailing or delivery.

In the drawings, FIG. 1 is a schematic view of a typical process in accordance with this invention for printing and assembling correspondence units, such as addressed bills or the like.

Figure 1:
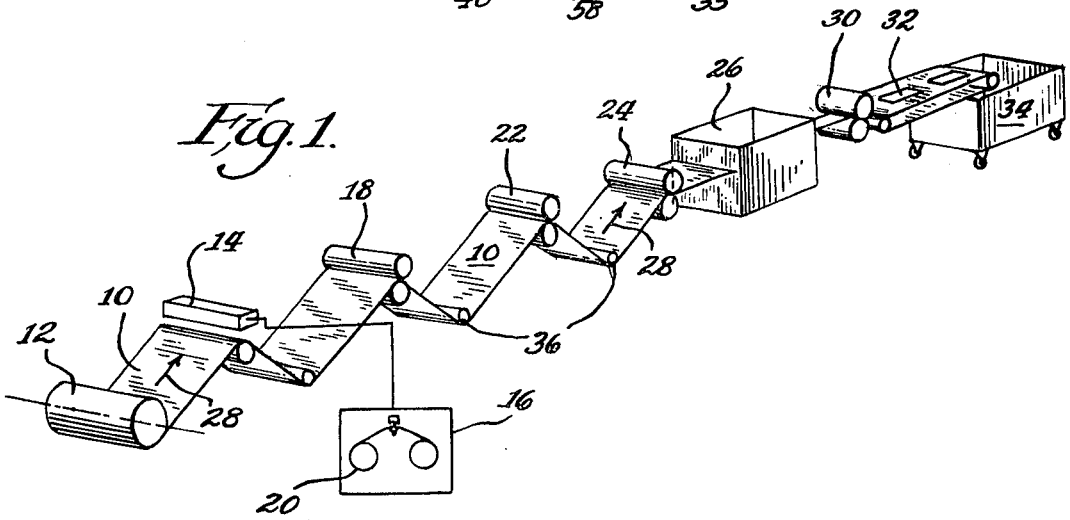

Referring to FIG. 1, a single strip of raw paper 10 is unwound from roll 12 and advanced through a jet printing unit 14 such as the Mead-Dijit unit described above. The jet printer 14 is controlled by computer 16 which is appropriately programmed to cause the jet printer to lay out on paper strip 10 the desired printing information. That portion of the printing information which is unchanging between respective envelope units may be built into the computer program if desired, or it can be added later by printing rollers 18, which may also assist to advance paper strip 10. The types of subject matter which could be expected to remain unchanging between individual envelope units would be, for example, the name of the company sending out the bill, invoice, or other document, and various lines, blocked-off spaces, and the like, which are used to define various areas, and to segregate, for example, the total amount owed from the various individual entries on a bill.

The information to be printed, which varies between individual letter units, may be stored in the computer system by any conventional means, for example, through the use of one or more spools of magnetic tape 20, which may be conventionally read by the computer in accordance with the desired program, and the information of tape 20 transmitted to the jet printer for application to the envelope units in any desired arrangement and manner. Addresses and individual billing information would be included.

After paper strip or webbing 10 has passed through jet printer 14 and optional auxilary printer 18, and the printing operation is accordingly completed, it passes to a conventional web punching station 22 of a type which may be obtained, for example, from the Hamiliton Tool Company of Hamilton, Ohio. There, appropriate tear lines, cut-out portions, and perforations are inscribed into the flat envelope unit as desired.

From there, strip or webbing 10 can move to a conventional adhesive applying station 24, in which the appropriate adhesive lines are applied. Typical examples of lines of weakness and the like applied by section 22 and adhesive lines or spots applied by station 24 are shown and discussed in the drawings below.

After passing through adhesive application station 24, the paper strip 10 enters folding station 26, in which strip 10 is folded, typically along longitudinal lines of folding parallel to axis 28 of strip 10. Thereafter, the folded strip 10 is severed into individual envelope units at cutting station 30, and the finished envelopes, which may have been pre-addressed and prestamped with permit-type postage, may be delivered to the mailing recepticle 34 for delivery to the Post Office without further manual handling.

Tension rollers 36 are provided to keep a predetermined desired tension on strip or web 10 during processing.

Folding and cut-off sections 26, 30 are also commercially available from the Hamilton Tool Company mentioned above. Furthermore, the maintenance of all of the respective processing sections in appropriate registry with each other's operations can be effected by conventional and presently commercial means, particularly since the grain of the paper strip 10 is preferably parallel to axis 28 of paper strip 10, and accordingly the strip does not stretch appreciably during processing.

Figure 2:
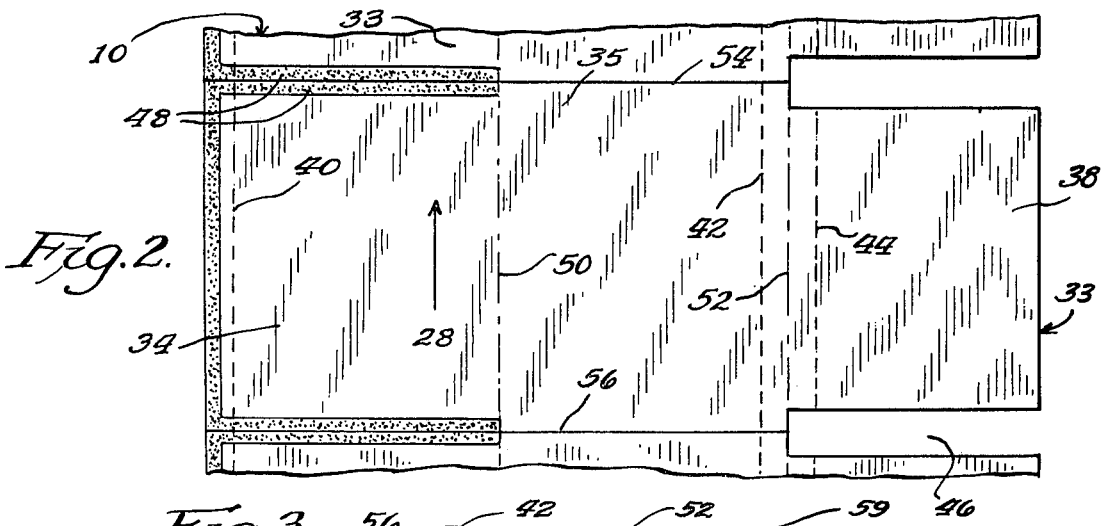
FIG. 2 is a plan view of one embodiment of a blank envelope unit as part of a paper strip, in accordance with this invention.
Figure 3:
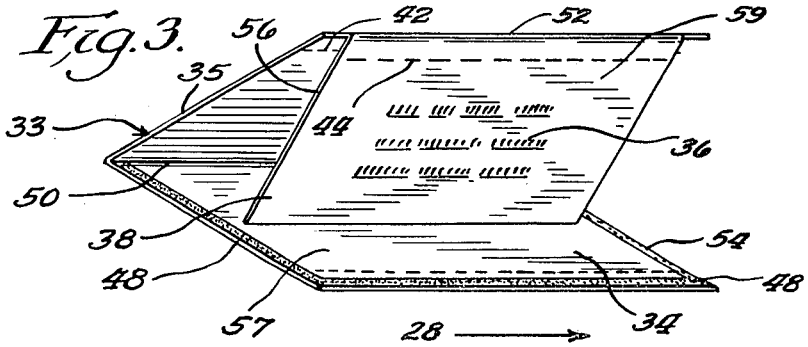
FIG. 3 is a perspective view of the envelope unit of FIG. 1 in process of folding.
Figure 4:
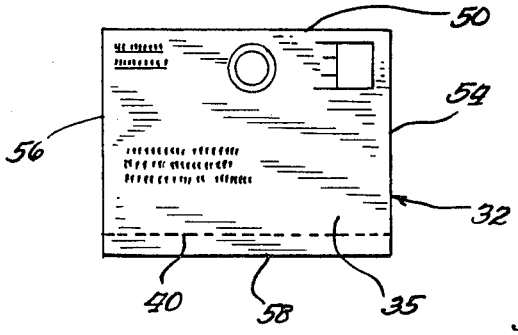
FIG. 4 is a plan view of the completed folded and addressed envelope unit.

Referring to FIGS. 2 through 4, one particular embodiment of envelope unit which can be manufactured in accordance with FIG. 1 is disclosed.

FIG. 2 shows a blank, flat portion 33 of strip 10 which will be assembled into an envelope section 32. Strip 10 may have been printed on the reversed side from that shown in FIG. 2, with the general addressing and postage permit stamp being placed on envelope-defining panels 34 or 35, and a message 36 being placed on message panel 38. A series of perforation lines 40, 42 and 44 have been inscribed on blank 33 by web punching station 22. Punching station 22 has also removed cut-away portions 46, so that message panel 38 will be of less width than first and second envelope-defining panels 34, 35, for ease of removal of the message panel on opening envelope section 32.

Adhesive lines 48 have been applied by adhesive applying station 24 so that, upon folding, envelope-defining panels 34, 35 will adhere together to define an envelope, with message panel 38 inside.

FIG. 3 shows envelope unit blank 33 in the process of being folded along fold lines 50, 52 in folding station 26. As stated above, lines 50, 52 are in longitudinal relation to the axis and direction of motion 28 of paper strip 10, and preferably parallel thereto.

After completion of the folding, seal lines 48 adhere to appropriate edges of envelope-defining panel 35 and message panel 38, the arrangement being folded together so that tear lines 40, 42 and 44 lie parallel and adjacent to each other, and for the most part in spaced relation from seal lines 48.

Thereafter, each blank 33 is separated by severing at cutting station 30 from its neighbor envelope units by severing along lines 54, 56, which are in transverse relationship to axis 28 of paper strip 10. Accordingly, the separate envelope 32 is formed, and deposited into receptacle 34 for mailing or other distribution.

As stated above, separate active reproduction coatings such as attapulgite, and crystal violet lactone or the like, may be placed on opposite sides 57, 59 of blank 33. Accordingly, upon folding as shown in FIG. 3, side 59 of message panel 58 enters into facing relationship with side 57 of panel 34.

As a result, after the form has been distributed, an oil delivery truck driver or the like can print, stamp or wirte the amount of oil delivered on envelope 32, which has been pre-addressed with customer's name, address, and any other pertinent data which is known at the time of printing. Thus, the pertinent facts relating to the delivery of oil may be entered on both the outer envelope and inner message panel 38 simultaneously, by interaction of the active coatings.

When it is desired to open the envelope, one grasps the bottom tab 58 of envelope 32 and pulls it to simultaneously tear lines of weakness 40, 42 and 44, which are adjacent and parallel to each other in separate layers of envelope 32. Upon removing bottom tab 58 from envelope 32, message panel 38 is freed from its integral connection with envelope panel 35, and accordingly may be removed from the envelope.

If desired, the printing on the outer panel of envelope 32 may be inverted so that the tear lines 40, 42 and 44 are at the top rather than at the bottom of envelope unit 32.

Accordingly, envelope unit 32 comprises an integral, folded single sheet including first and second envelope-defining panels 34, 35, folded and peripherally sealed together and integrally connected by a fold line 50. The third, message panel 38 is disposed between the envelope-defining panel 35 and integrally connected to envelope-defining panel 35 by a second fold line 52, while the edge of the message panel 38 opposite to the second fold line is unattached to the envelope-defining panels. As stated above, the envelope can be opened by severing the parallel lines of weakness 40, 42 and 44 in the three panels.

Figure 5:
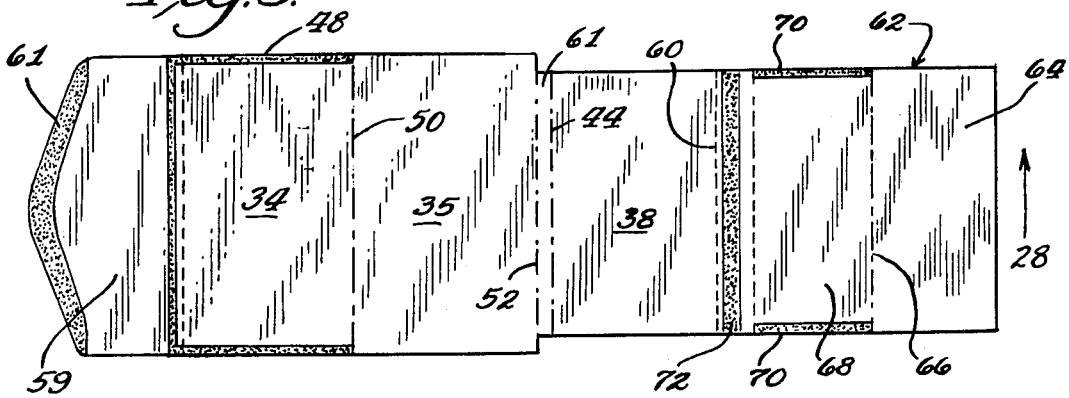
FIG. 5 is a plan view of another blank for an envelope unit which can be prepared in accordance with this invention, with the remaining parts of the paper strip not shown.

Referring to FIG. 5, a variant of the structure of FIGS. 2 through 4 is disclosed. Panels 34, 35 and 38, and their respective fold lines and adhesive sections, are identical to that disclosed in FIGS. 2, 3 and 4 except that one adhesive line 48 has been eliminated, and replaced by gummed flap panel 59. having a gum line 61, for sealing the envelope unit. Also, tear line 42 is omitted. The edge of message panel 38 which is opposite from tear line 44 is connected by a severable fold line 60 to a return envelope blank 62. As panels 34, 35 and 38 are folded in folding station 26 in the manner previously described, panel 64 is also folded on line 66 into envelope-forming relation with panel 68, being retained in such relation by sealant lines 70. Envelope flap section 72, carrying a moistenable gum line which can be applied by adhesive station 24, can then fold over in the conventional manner to seal the return envelope by the user, after it is severed from message panel 38 along line 60. Return envelope 62 and message panel 38 are folded into the envelope defined by panels 34, 35 and 59 along line 44 at folding station 26, and may be obtained by opening the envelope unit in the manner previously described. Panel 35 may be narrower than panel 34 so that tab 61 protrudes and may be grasped to tear away panel 38 and envelope 62 along line 52. Variable information such as the receiver's return address and an information code may be printed on the paper portion defining return envelope 62 at printing unit 14. Unchanging information such as the original sender's address may be printed on envelope 62 at auxiliary printer 18.

Figure 6:
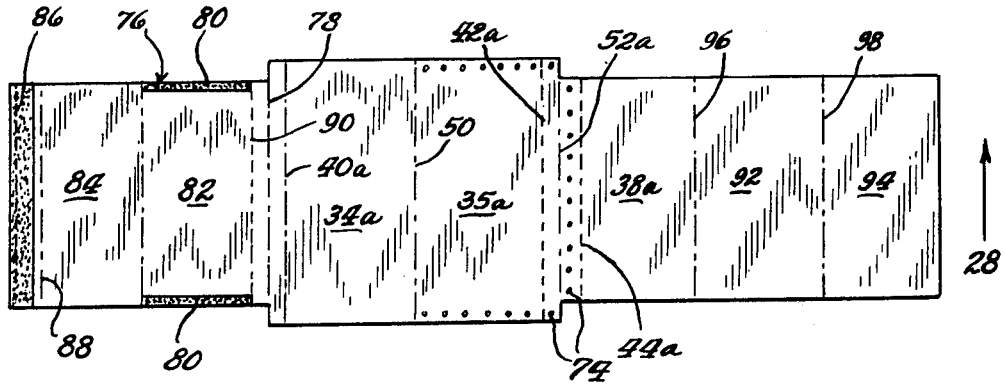
FIG. 6 is a third embodiment of a blank for an envelope unit, with the remaining parts of the paper strip not shown.

The blank of FIG. 6 also defines panel **34*a*, 35*a* and 38*a*, which are essentially identical to the corresponding panels of FIGS. 2 through 4, except that adhesive station 24 has applied a different pattern of spot seals 74, which achieve essentially the same effect as seal lines 48 after assembly of the device. A return envelope section 76 is defined adjacent panel 34*a*, being connected to it by fold line 78** which may be a line of tearing weakness.

In a manner similar to the previous embodiment of FIG. 5, sealant lines 80 are applied to panel 82, and panel 84 is folded over and brought into contact with sealant lines 80. Flap section 86 contains a sealant line for moistening to seal return envelope 76 at a later time by the user, and is foldable on fold line 88, which may also be inscribed by folding section 26. The entire structure then may be folded between panels **34*a* and 35*a* along fold line 78, and may be removed by the user by tearing along line of weakness 90, which generally should be at least as wide as flap 86, unless flap 86 is folded outwardly against panel 84**.

Message panel **38*a* folds inwardly between panels 34*a* and 35*a* about fold line 52*a*. The appropriate lines of weakness 40*a*, 42*a*, 44*a*** are present to permit opening of the envelope unit.

The remaining panels 92, 94 may serve as extra sections of message panel 38*a*, or one or more of them may be printed with desired file information corresponding to the address on message panel 34*a* or 35*a* and any other information desired to be retained. Then, either or both of panels 92, 94 are severed along lines 96 or 98 at station 30, and sent by conventional means to a filing receptacle, so that a desired record of the envelope unit produced in accordance with this invention can be retained.

If either or both of panels 92, 94 are to be included in the envelope unit, they may be correspondingly folded along lines 96, 98 rather than severed, and then folded into the envelope defined by panels 34*a* and 35*a*, so that they remain intact with message panel 38*a*, for a longer message.

Direction 28 shows the long axis of paper strip or web 10 with respect to both FIGS. 5 and 6.

Figure 7:
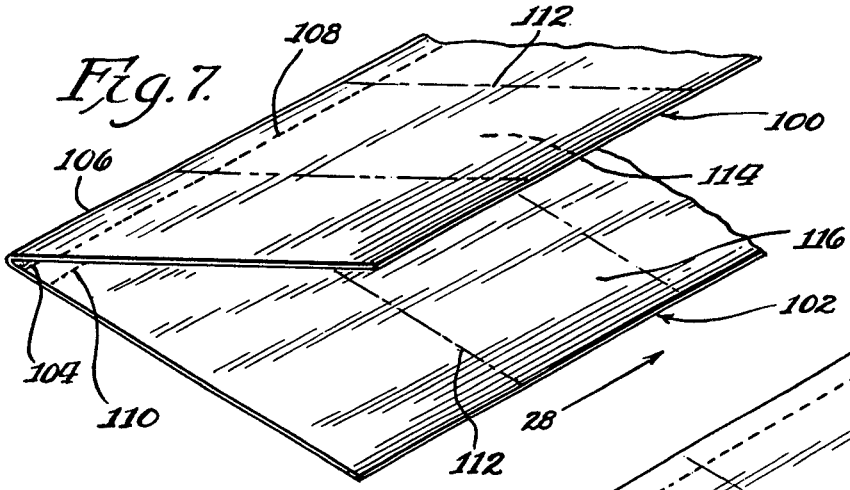
FIGS. 7 and 8 are perspective views of fourth and fifth embodiments, respectively, of envelope units, partially assembled, whch can be utilized in conjunction with the method of this invention.

Turning now to FIG. 7, another embodiment of multilayer paper envelope form which may be produced by the process of this invention is disclosed. The paper strip 10 (FIG. 1) is folded in accordance with the method of this invention into a pair of overlying panels 100, 102, which may be retained in folded position by the application of a line of adhesive 104 at fold line 106.

Tear lines 108, 110 may be formed parallel to fold line 106 in each panel 100, 102 for easy removal of the panels. Other transverse tear lines 112 provide separate, severable envelope form sections for use.

If desired, lines of reaction coatings may be provided to strip 10, so that the underside of panel 100, for example, may be coated with a carbon layer 114 or another appropriate active layer, for transferring type or other imprinted marks from the upper surface of panel 100 to upper surface 116 of panel 102.

Figure 8:
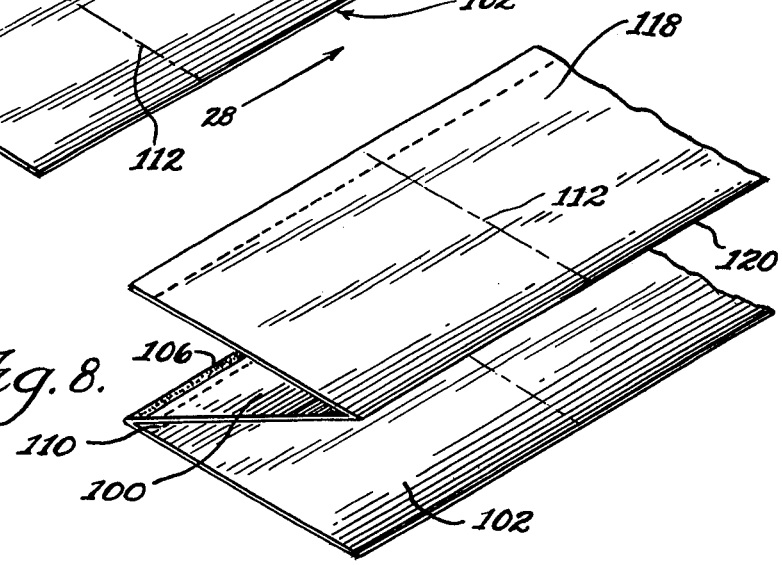

FIG. 8 shows a triple layer form identical to that of FIG. 7, but with an added panel 118 having a folded and severable connection 120 with panel 100.

The lower sides of the upper two panels 100, 118 may be coated with an active coating to provide a carbon paper function. Paper strip 10 may have appropriately placed lines of active layers for reproduction of printing on inner layers of a stack. Such paper is available from the NCR Corporation.

Accordingly, both the forms of FIG. 7 and FIG. 8 can be pre-printed in accordance with the method of this invention, and later, supplemental information can be added in the field to all layers of the forms, prior to separating them into their respective panels.

As a further alternative embodiment, the paper strip may be pre-cut into single sheets, which are then fed automatically, or as otherwise desired, through a Xerox 1200 computer-controlled copier, for selectively variable imprinting with desired information and the like. The single sheet may then be folded and perforated as desired, preferably, with one portion being designed in any conventional manner to form a sealable return envelope. The entire folded arrangement is then inserted into a conventional window envelope, with the desired mailing address printed on the sheet being positioned to show through the window.

One particular advantage of this technique is that other inserts such as advertisements and the like can be inserted along with the printed sheet into the window envelope.

The receiver opens the window envelope and removes the contents, tearing away the return envelope per instructions imprinted thereon, to separate it from the invoice or other message portion.

The various embodiments of the invention described above all have the common characteristic of permitting the automated production of variable message information such as bills or the like, for sending to separate addresses. Furthermore, this can be accomplished with the savings of paper resulting from the elimination of the tearable side strips, without the need for preproduced paper forms, since the invention of this application can utilize blank paper stock.

The above has been offered for illustrative purposes only, and is not to be interpreted as limiting the scope of this invention, which is as defined in the claims below.

That which is claimed is:

1. Apparatus for forming pre-printed, cut, and folded message units comprising:

means for receiving and holding a single roll of paper adapted to supply to said apparatus a single-thickness paper web having a grain running parallel to the longitudinal axis of said web;

friction roller advancing means, adapted to advance said single-thickness web off of a roll of paper held by said receiving and holding means;

means for continuously printing predetermined messages on said single web by forming characters of said messages in a direction parallel to the longitudinal axis of said paper web as said web is continuously advanced in a longitudinal direction;

means connected to said printing means for directing said printing means to print individual and different subject matter along various segments of said web as the web is moved through said continuous printing means;

means for applying adhesive to said single web in predetermined locations as said web is advanced;

means for folding said web into a desired message unit configuration, said folding means being positioned to receive said web after the web has passed through said continuous printing means and said adhesive applying means; and means for cutting said web into individual segments to form individual message units.

2. The apparatus according to claim 1 wherein said means for controlling the messages to be printed on said web is a preprogrammed computer, and wherein said printing means is a jet printer.

3. The apparatus according to claim 2 further comprising an auxiliary printer formed by printing rollers through which said web is advanced for printing the same message on each message unit.

4. The apparatus according to claim 1 further comprising at least one tension roller engaging said web for maintaining desired tension thereon.

5. Apparatus for continuously forming printed, folded, and sealed message envelope units in which said units are defined by first and second envelope-defining panels, said panels being folded and peripherally sealed together, and integrally connected by a fold line, a third message panel disposed between said envelope-defining panels when folded to form said envelope unit, and integrally connected to one of said envelope defining panels by a second fold line, the edge of the message panel opposite to said second fold line being unattached to said envelope-defining panels;

means for receiving and holding a single roll of paper web;

friction roller means for advancing a single thickness of said web from a roll held by the receiving and holding means;

means for printing identical indicia on different, spaced portions of said web as the paper web is advanced through said continuous printing means;

computer-controlled printing means adapted for printing differing indicia upon various segments of said single-thickness web, said computer-controlled printing means being adapted to print said differing indicia in registry with the identical indicia;

means for applying adhesive to said web in predetermined locations as the web is advanced;

means for folding said web into a desired message envelope configuration, said folding means being positioned to receive said web after the web has passed through the printing means; and means for cutting said folded web to form individual, separate message envelope units.

6. Apparatus for continuously forming printed, folded, and sealed message envelope units, said apparatus comprising:

means for receiving and holding a single roll of paper web;

friction roller means for advancing a single thickness of said web from a roll held by the receiving and holding means;

means for continuously printing identical indicia on different, spaced portions of said web as the paper web is advanced through said continuous printing means;

computer-controlled printing means adapted for printing differing indicia on various segments of said single thickness web, said computer-controlled printing means being adapted to print said differing indicia in registry with the identical indicia;

means for applying adhesive to said web in predetermined locations as the web is advanced;

means for folding said web into a desired message envelope configuration, said folding means being positioned to receive said web after the web has passed through the printing means;

and means for cutting said folded web to form individual, separate message envelope units.

7. The apparatus of claim 6 in which said computer-controlled printing means adapted for printing differing indicia is adapted to print said indicia in a direction parallel to the longitudinal axis of said paper web as said web is continuously advanced in a longitudinal direction.

* * * * *